US010877393B2

(12) United States Patent
Kanno et al.

(10) Patent No.: US 10,877,393 B2
(45) Date of Patent: Dec. 29, 2020

(54) IMAGE FORMING DEVICE

(71) Applicant: FUJI XEROX CO., LTD., Tokyo (JP)

(72) Inventors: Makoto Kanno, Kanagawa (JP); Tomoyuki Hamachi, Kanagawa (JP); Ryo Fukuno, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/520,689

(22) Filed: Jul. 24, 2019

(65) Prior Publication Data

US 2020/0310277 A1 Oct. 1, 2020

(30) Foreign Application Priority Data

Mar. 29, 2019 (JP) ..... 2019-066711

(51) Int. Cl.
*G03G 15/06* (2006.01)

(52) U.S. Cl.
CPC ..... *G03G 15/065* (2013.01)

(58) Field of Classification Search
CPC ..... G03G 15/065; G03G 15/0815
See application file for complete search history.

(56) References Cited

U.S. PATENT DOCUMENTS 4,491,083 A * 1/1985 Itaya ..... G03G 15/095 399/264
5,177,533 A * 1/1993 Ishiguro ..... G03G 15/0898 399/130
5,387,963 A * 2/1995 Kajimoto ..... G03G 15/0815 399/273
5,570,164 A * 10/1996 Yamamoto ..... G03G 15/0815 15/256.51
6,151,475 A * 11/2000 Uno ..... G03G 15/0808 347/55
6,512,909 B2 * 1/2003 Ozawa ..... G03G 13/08 399/265
8,494,403 B2 * 7/2013 Park ..... G03G 15/0813 399/222
2002/0039496 A1 * 4/2002 Aoki ..... G03G 13/08 399/55
2004/0022549 A1 * 2/2004 Ozawa ..... G03G 15/0815 399/55

(Continued)

FOREIGN PATENT DOCUMENTS

JP 2830878 B2 * 12/1998
JP 2003005515 A * 1/2003

(Continued)

*Primary Examiner* — David J Bolduc
(74) *Attorney, Agent, or Firm* — Sughrue Mion, PLLC

(57) ABSTRACT

An image forming device includes: a developer holder that is rotatably arranged opposing a latent image holder holding an electrostatic latent image, holds developer including carrier and toner charged to a predetermined regular polarity, has a potential of the same polarity as the regular polarity applied thereto, and develops the electrostatic latent image using the toner; an opposite electrode that is arranged opposing the developer holder with a predetermined gap therebetween; and a controller that changes at least one of a potential applied to the opposite electrode and a rotation direction of the opposite electrode in accordance with an area coverage of the electrostatic latent image of the latent image holder.

17 Claims, 13 Drawing Sheets

(56) References Cited

U.S. PATENT DOCUMENTS

2005/0196201 A1* 9/2005 Hagiwara ..... G03G 15/065 399/270
2005/0276635 A1* 12/2005 Ikeda ..... G03G 15/09 399/273
2007/0019995 A1* 1/2007 Teraoka ..... G03G 15/0815 399/281
2007/0025776 A1* 2/2007 Suzuki ..... G03G 15/0815 399/272
2007/0041750 A1* 2/2007 Mizuta ..... G03G 15/0898 399/283
2007/0071505 A1* 3/2007 Do ..... G03G 15/0907 399/270
2007/0212122 A1* 9/2007 Maeyama ..... G03G 15/0887 399/267
2007/0280738 A1* 12/2007 Uetake ..... G03G 15/0891 399/253
2007/0292165 A1* 12/2007 Hirayama ..... G03G 15/0815 399/267
2008/0056786 A1* 3/2008 Ishino ..... G03G 21/0011 399/357
2008/0069618 A1* 3/2008 Ishino ..... G03G 5/08214 399/360
2008/0175625 A1* 7/2008 Goto ..... G03G 15/0808 399/252
2008/0181675 A1* 7/2008 Fujishima ..... G03G 15/0815 399/267
2008/0181677 A1* 7/2008 Sakai ..... G03G 15/0921 399/277
2008/0199228 A1* 8/2008 Tokimatsu ..... G03G 21/10 399/267
2008/0206661 A1* 8/2008 Fujishima ..... G03G 15/0808 430/48
2008/0219712 A1* 9/2008 Hirayama ..... G03G 15/0808 399/285
2008/0226320 A1* 9/2008 Sakata ..... G03G 15/065 399/55
2008/0226350 A1* 9/2008 Goto ..... G03G 15/0907 399/240
2008/0253811 A1* 10/2008 Minegishi ..... G03G 15/095 399/272
2008/0279592 A1* 11/2008 Matsumoto ..... G03G 15/0879 399/259
2009/0047045 A1* 2/2009 Sheen ..... G03G 15/0928 399/267
2009/0103956 A1* 4/2009 Matsui ..... G03G 21/10 399/264
2009/0154963 A1* 6/2009 Ito ..... G03G 15/0818 399/279
2009/0214971 A1* 8/2009 Yoshida ..... G03G 9/0819 430/97
2009/0252513 A1* 10/2009 Maeyama ..... G03G 15/065 399/55
2009/0285597 A1* 11/2009 Uetake ..... G03G 15/0815 399/100
2009/0317142 A1* 12/2009 Takai ..... G03G 15/0808 399/270
2009/0317736 A1* 12/2009 Tsutsui ..... G03G 9/1136 430/105
2010/0303510 A1* 12/2010 Ohashi ..... G03G 15/0815 399/273
2011/0058835 A1* 3/2011 Imura ..... G03G 15/065 399/55
2011/0058836 A1* 3/2011 Imura ..... G03G 15/0806 399/55
2011/0188897 A1* 8/2011 Goto ..... G03G 15/0808 399/264
2012/0051782 A1* 3/2012 Gyoutoku ..... G03G 21/1676 399/119
2013/0022365 A1* 1/2013 Fujishima ..... G03G 15/0806 399/55
2013/0272751 A1* 10/2013 Eiki ..... G03G 15/09 399/273
2014/0270860 A1* 9/2014 Asai ..... G03G 21/1817 399/283
2014/0369705 A1* 12/2014 Matsui ..... G03G 15/0266 399/55
2014/0376973 A1* 12/2014 Watanabe ..... G03G 15/0907 399/270
2015/0198909 A1* 7/2015 Nakayama ..... G03G 15/0806 399/53
2016/0091826 A1* 3/2016 Furukawa ..... G03G 15/0907 399/273
2016/0103413 A1* 4/2016 Shimizu ..... G03G 15/0806 399/264
2017/0212450 A1* 7/2017 Shishikura ..... G03G 15/0881
2017/0269508 A1* 9/2017 Shimizu ..... G03G 15/065
2020/0033780 A1* 1/2020 Nagata ..... G03G 15/502

FOREIGN PATENT DOCUMENTS

JP 2004-191766 A 7/2004
JP 2007-086361 A 4/2007
JP 2008225329 A * 9/2008
JP 2013003374 A * 1/2013
JP 2015087416 A * 5/2015 ..... G03G 21/0058

* cited by examiner

IMAGE FORMING DEVICE

CROSS-REFERENCE TO RELATED APPLICATIONS

This application is based on and claims priority under 35 USC 119 from Japanese Patent Application No. 2019-066711 filed Mar. 29, 2019.

BACKGROUND

(i) Technical Field

The present disclosure relates to an image forming device.

(ii) Related Art

There is a known image forming device that has: an image carrier that has a photosensitive layer; a charging unit that abuts and charges the image carrier to a predetermined potential; an exposing unit that forms an electrostatic latent image on a charged surface of the image carrier; a developing unit that visualizes the electrostatic latent image as a toner image and is provided with a developer carrier arranged so as to oppose the image carrier and a supply unit that supplies developer to the developer carrier; and a transfer unit that abuts the image carrier and transfers the formed toner image to a transferred material. The image forming device includes a reversed polarity toner recovery process in which, after image forming has been completed, a voltage applied to the transfer unit is made to have the reverse polarity compared to when image forming is carried out, a voltage applied to the charging unit is made to have the same polarity and to be less than the absolute value compared to when image forming is carried out, a voltage that is less than or equal to a surface potential of the image carrier is applied to the developer carrier of the developing unit, and a voltage with which a potential difference with the voltage applied to the developer carrier decreases compared to during printing is applied to the supply unit (Japanese Unexamined Patent Application Publication No. 2004-191766).

There is also a known developing device that is provided with: a developer carrier that faces an image carrier on which an electrostatic latent image is carried, can be rotated, and carries developer on a surface thereof; a charging member that comes into contact with or close to the developer on the developer carrier and regulates charging of the developer; and a bias power source that applies a predetermined bias to the charging member. The bias power source is provided with: a charging bias applying unit that applies a charging bias to between the charging member and the developer carrier and charges the developer on the developer carrier when image forming is carried out; a discharging bias applying unit that applies a discharging bias to between the charging member and the developer carrier and discharges the developer that has adhered to the charging member when image forming is not carried out; and a bias switching unit that switches a connection between the charging bias applying unit and the discharging bias applying unit (Japanese Unexamined Patent Application Publication No. 2007-86361).

SUMMARY

Aspects of non-limiting embodiments of the present disclosure relate to suppressing image quality defects caused by toner deterioration and toner charge fluctuation during continuous running.

Aspects of certain non-limiting embodiments of the present disclosure address the features discussed above and/or other features not described above. However, aspects of the non-limiting embodiments are not required to address the above features, and aspects of the non-limiting embodiments of the present disclosure may not address features described above.

According to an aspect of the present disclosure, there is provided an image forming device provided with: a developer holder that is rotatably arranged opposing a latent image holder holding an electrostatic latent image, holds developer including carrier and toner charged to a predetermined regular polarity, has a potential of the same polarity as the regular polarity applied thereto, and develops the electrostatic latent image using the toner; an opposite electrode that is arranged opposing the developer holder with a predetermined gap therebetween; and a controller that changes at least one of a potential applied to the opposite electrode and a rotation direction of the opposite electrode in accordance with an area coverage of the electrostatic latent image of the latent image holder.

BRIEF DESCRIPTION OF THE DRAWINGS

Exemplary embodiments of the present disclosure will be described in detail based on the following figures, wherein.

DETAILED DESCRIPTION

Next, with reference to the drawings, exemplary embodiments and specific examples will be given hereinafter for the present disclosure to be described in greater detail; however, the present disclosure is not restricted to these exemplary embodiments and specific examples.

Furthermore, in the description using the drawings hereinafter, please be aware that the drawings are schematic and the ratios of the dimensions and so forth are different from those in reality, and members other than those required for the description are not depicted as appropriate to aid understanding.

Figure 1:
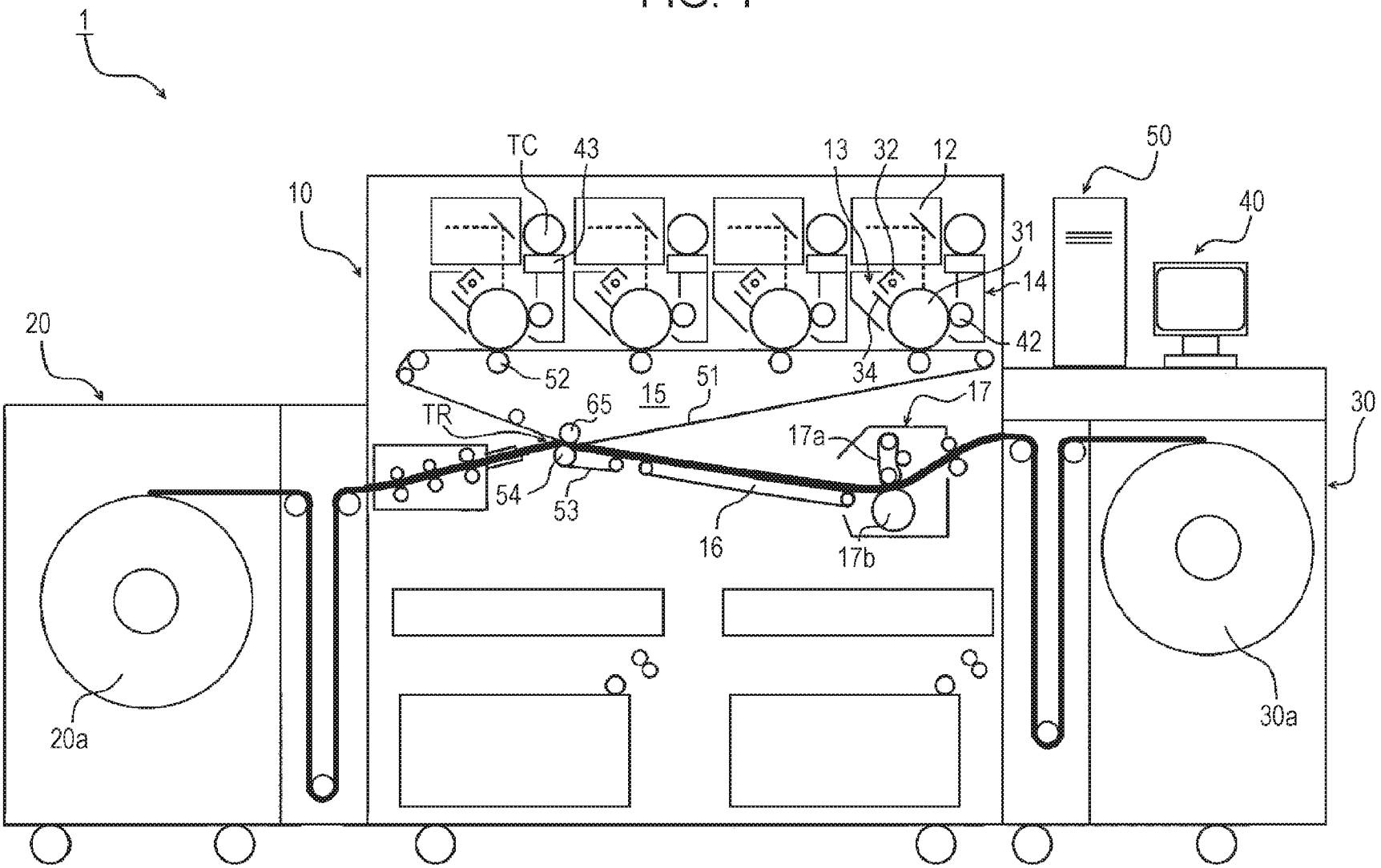
FIG. 1 is a cross-sectional schematic view depicting an example of a schematic configuration of an image forming device.

First Exemplary Embodiment (1) Overall Configuration and Operation of Image Forming Device (1.1) Overall Configuration of Image Forming Device FIG. 1 is a cross-sectional schematic view depicting an example of a schematic configuration of an image forming device 1 according to the present exemplary embodiment.

The image forming device 1 is configured including an image forming unit 10, a paper supply device 20 mounted at one end of the image processing unit 10, a paper recovery unit 30 mounted at the other end of the image processing unit 10 and in which printed paper is recovered; an operation display unit 40, and an image processing unit 50 that generates image information from printing information transmitted from a higher-level device.

The image forming unit 10 is configured including a system control device 11, exposure devices 12, photoconductor units 13, developing devices 14, a transfer device 15, a paper conveying device 16, a fixing device 17, a driving device 18 (not depicted; see FIG. 9), and a power source device 19 (not depicted; see FIG. 9), and forms image information received from the image processing unit 50 as a toner image on continuous paper S that is fed from the paper supply device 20.

The paper supply device 20 has a paper feeding member 20*a* that is rotatably supported and has the continuous paper S wound therearound in the form of a roll, and is configured so as to supply the continuous paper S to the image forming unit 10 while tensioning the continuous paper S.

The paper recovery unit 30 recovers the continuous paper S on which image forming has been carried out by the image forming unit 10, by winding in the continuous paper S using a rotationally driven winding roll 30*a*.

The operation display unit 40 is used for inputting various types of settings and instructions and displaying information. In other words, the operation display unit 40 corresponds to a user interface so to speak, and, to be specific, is configured by combining a liquid crystal display panel, various types of operation buttons, a touch panel, or the like.

(1.2) Configuration and Operation of Image Forming Unit

In the image forming device 1 having this kind of configuration, continuous paper S extending from the paper feeding member 20*a* of the paper supply device 20 is conveyed to the image forming unit 10 in accordance with an image forming timing.

The photoconductor units 13 are respectively disposed in parallel below the exposure devices 12 and provided with photoconductor drums 31 serving as rotationally driven latent image holders. A charger 32, an exposure device 12, a developing device 14, a first transfer roller 52, and a cleaning device 34 are arranged around each photoconductor drum 31 in the rotation direction thereof.

In the developing devices 14, developing rollers 42 serving as developer holders are arranged opposing the photoconductor drums 31. The developing devices 14 are configured in substantially the same manner except for the developer, and form toner images of yellow (Y), magenta (M), cyan (C), and black (B) on the photoconductor drums 31 using the respective developing rollers 42.

Exchangeable toner cartridges TC that house developer and developer supply devices 43 that supply developer from the respective toner cartridges TC to the developing devices 14 are arranged above the developing devices 14.

The surface of the photoconductor drums 31, which rotate, are charged by the chargers 32, and electrostatic latent images are formed by latent image-forming light emitted from the exposure devices 12. The electrostatic latent images formed on the photoconductor drums 31 are developed as toner images by the developing rollers 42.

The transfer device 15 is configured from: an intermediate transfer belt 51 serving as an example of an image holder with which multiple transfer of the toner images formed by the photoconductor drums 31 of the photoconductor units 13 is carried out; the first transfer rollers 52 that sequentially transfer the toner images formed by the photoconductor units 13 to the intermediate transfer belt 51 (first transfer); and a second transfer belt 53 serving as an example of a transfer member that carries out batch transfer of the toner images superposed and transferred on the intermediate transfer belt 51 to paper, which is a recording medium (second transfer).

The second transfer belt 53 is stretched by a second transfer roller 54 and a separation roller 55 and is held between a backup roller 65 and the second transfer roller 54 to form a second transfer part TR, the backup roller 65 being arranged at the rear surface side of the intermediate transfer belt 51.

The toner images formed on the photoconductor drums 31 of the photoconductor units 13 are sequentially electrostatically transferred (first transfer) onto the intermediate transfer belt 51 by the first transfer rollers 52 to which a predetermined transfer voltage is applied from a power source device or the like (not depicted) controlled by the system control device 11, and superposed toner images in which the toner images are superposed are formed.

The superposed toner images on the intermediate transfer belt 51 are conveyed to the region in which the second transfer belt 53 is arranged (second transfer part TR) due to the movement of the intermediate transfer belt 51. The continuous paper S is supplied to the second transfer part TR from the paper supply device 20 in accordance with the timing at which the superposed toner images are conveyed to the second transfer part TR. Then, the transfer voltage is applied to the backup roller 65 that opposes the second transfer roller 54 with the second transfer belt 53 interposed, and the superposed toner images on the intermediate transfer belt 51 are batch-transferred onto the continuous paper S.

Residual toner on the surfaces of the photoconductor drums 31 is removed by the cleaning devices 34 and recovered to a waste toner housing unit (not depicted). The surfaces of the photoconductor drums 31 are recharged by the chargers 32.

The fixing device 17 has an endless fixing belt 17*a* that rotates in one direction and a pressure roller 17*b* that comes into contact with the peripheral surface of the fixing belt 17*a* and rotates in one direction, and a nip part (fixing region) is formed by a pressure contact region between the fixing belt 17*a* and the pressure roller 17*b*.

The continuous paper S on which the toner images are transferred in the transfer device 15 is conveyed to the fixing device 17 via the paper conveying device 16 with the toner images in a non-fixed state. The toner images are fixed to the continuous paper S conveyed to the fixing device 17, by the pair of the fixing belt 17*a* and the pressure roller 17*b* due to a heating and pressure-attaching action.

The continuous paper S for which fixing has been completed is fed to the paper recovery unit 30. The continuous paper S fed to the paper recovery unit 30 is wound in by the winding roll 30*a* while being tensioned.

(2) Configuration of Main Parts

Figure 2:
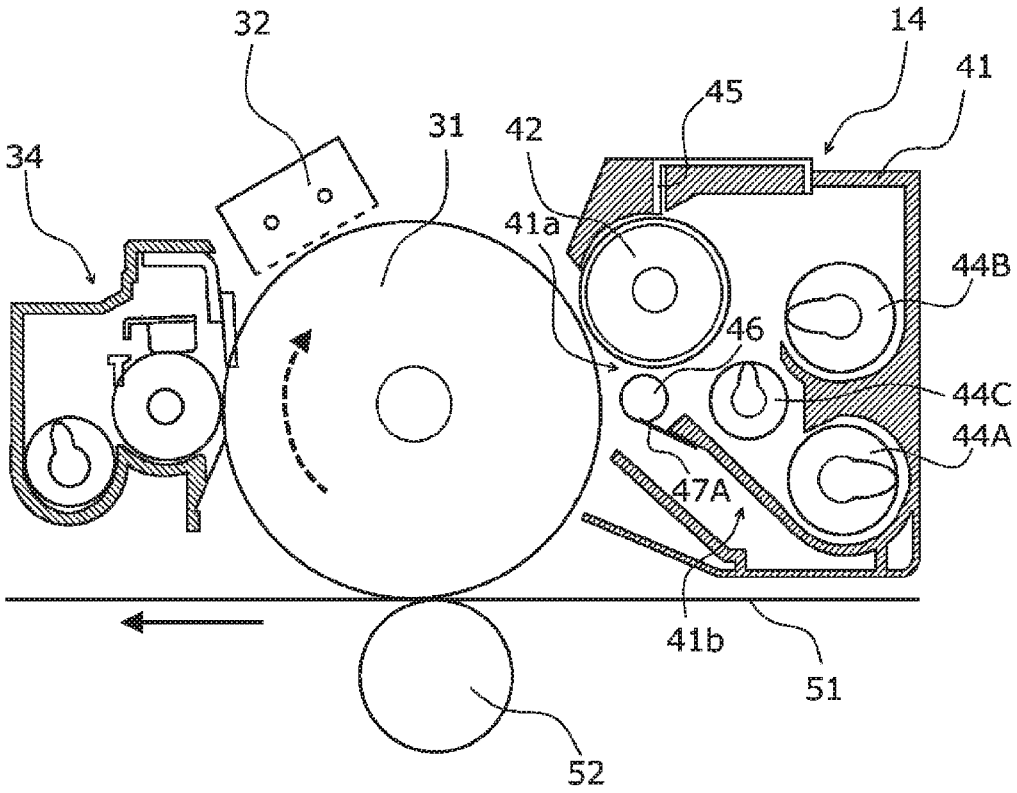
FIG. 2 is a longitudinal cross-sectional schematic view depicting a photoconductor unit and a developing device.
Figure 3:
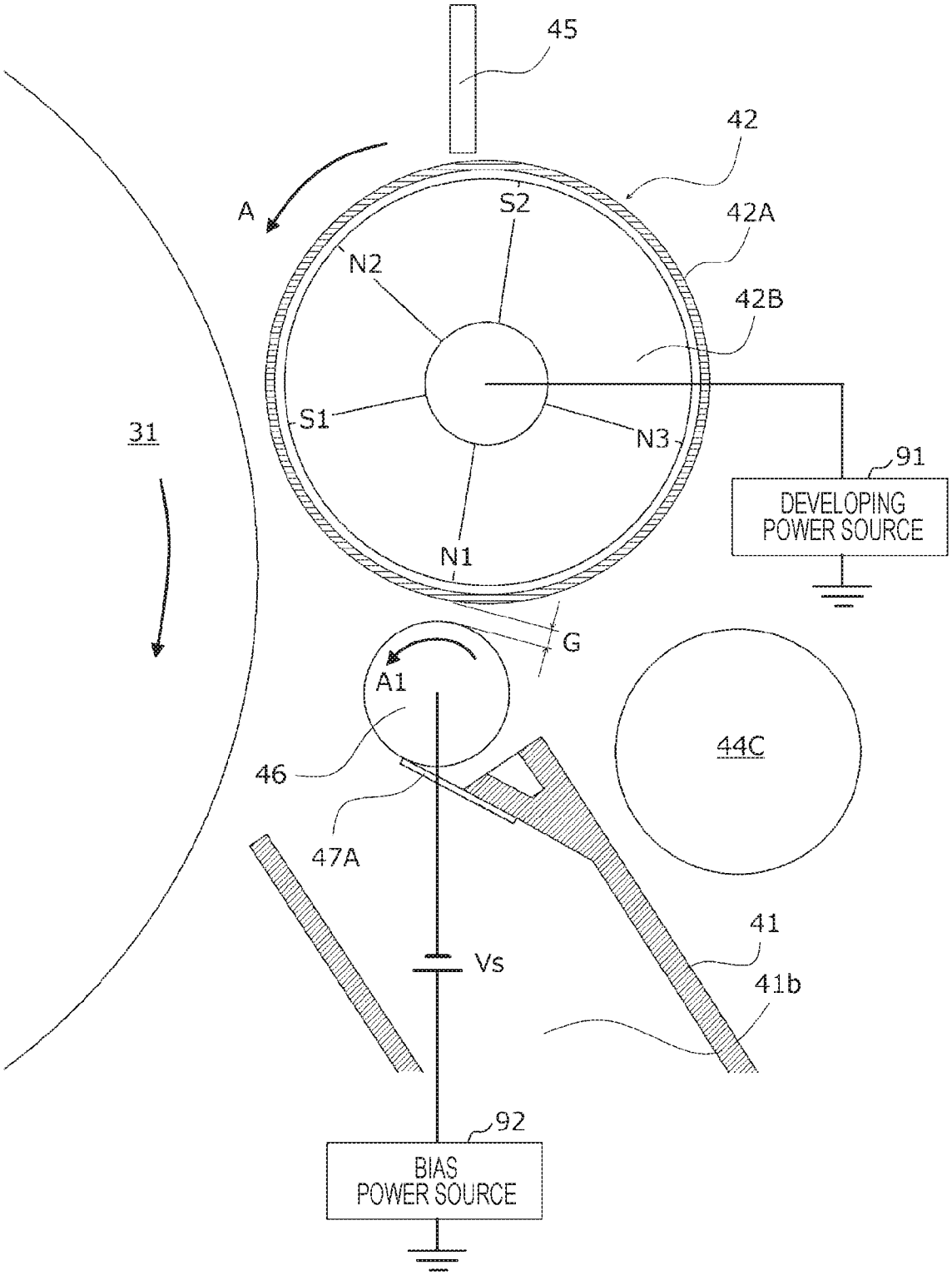
FIG. 3 is a partial cross-sectional view of the developing device depicting a developing roller and an opposite electrode.

FIG. 2 is a cross-sectional schematic view depicting the photoconductor unit 13 and the developing device 14, and FIG. 3 is a partial cross-sectional view of the developing device 14 depicting the developing roller 42 and an opposite electrode 46.

Hereinafter, a configuration and operation of the developing device 14 will be described with reference to the drawings.

(2.1) Overall Configuration of Developing Device

The developing device 14 is provided with: a developing housing 41 that houses developer; the developing roller 42 arranged opposing the photoconductor drum 31; a first stirring auger 44A that conveys toner supplied from the developer supply device 43, while stirring the toner so to be mixed with the developer; a supply auger 44B that supplies the developer to the developing roller 42; a second stirring auger 44C that stirs the developer that has separated from the developing roller 42; a layer regulating member 45 that trims the developer on the developing roller 42 to a predetermined developer layer thickness; and the opposite electrode 46 that adsorbs and recovers a toner cloud generated at a site where the developing roller 42 and the photoconductor drum 31 oppose each other, and also adsorbs and recovers toner by way of the developing action from the developer held on the outer periphery of the developing roller 42.

(2.2) Developing Roller

The developing roller 42 is arranged opposing the outer peripheral surface of the photoconductor drum 31 through an opening 41*a* formed in the developing housing 41, as depicted in FIG. 2. Furthermore, the developing roller 42 is provided with a cylindrical developing sleeve 42A that is rotatably supported with respect to the developing housing 41, and a magnet 42B that is a columnar magnet member provided in the space inside the developing sleeve 42A and fixed to the developing housing 41.

The developing sleeve 42A is configured in such a way that the developer is held on the outer peripheral surface thereof due to the magnetic force of the magnet 42B, and the developer is conveyed and supplied to an electrostatic latent image on the photoconductor drum 31 due to rotation of the developing sleeve 42A.

In the magnet 42B, as depicted in FIG. 3, magnetic poles are formed in the order of N3, S2, N2, S1, and N1 in the rotation direction of the developing sleeve 42A, and the developer that is drawn up by the N3 magnetic pole is held by the S2 magnetic pole up to the layer regulating member 45 and is trimmed by the layer regulating member 45. The N2 magnetic pole holds the developer regulated by the layer regulating member 45.

The S1 magnetic pole is arranged opposing the photoconductor drum 31, and holds the developer that has been conveyed from the N2 magnetic pole due to rotation of the developing sleeve 42A. A developing bias voltage is applied from a developing power source 91 for the image forming device 1 main body and an electric field is formed between the developing sleeve 42A and the photoconductor drum 31, toner within the developer moves toward the photoconductor drum 31, and carrier within the developer is held by the S1 magnetic pole and adhesion to the photoconductor drum 31 is suppressed.

The N1 magnetic pole is arranged opposing the opposite electrode 46 (described later) below the developing roller 42, and causes developer that has been conveyed from the S1 magnetic pole side due to rotation of the developing sleeve 42A to separate from the developing sleeve 42A. Specifically, due to the repulsion force of magnetic fields directed toward each of the N1 and N3 magnetic pole which are like poles, the magnetic force of the developing sleeve 42A becomes approximately 0, and the developer from which toner has been consumed due to developing separates from the developing sleeve 42A.

(2.3) Opposite Electrode

The opposite electrode 46 is arranged below the developing roller 42 in the opening 41*a* opposing the photoconductor drum 31 in the developing housing 41. The opposite electrode 46 is configured of a nonmagnetic SUS, for example, and is arranged in a position opposing the N1 magnetic pole of the developing roller 42 with there being a predetermined gap G with the outer peripheral surface of the developing roller 42. In the present exemplary embodiment, the gap G between the outer peripheral surface of the developing roller 42 and the outer peripheral surface of the opposite electrode 46 is narrower than the gap between the photoconductor drum 31 and the developing roller 42, and, specifically, is 0.4 mm or less.

Furthermore, the opposite electrode 46 is rotated in the same direction (the direction of arrow A1) as the rotation direction (the direction of arrow A) of the developing roller 42 by the driving device 18, which is not depicted. A bias power source 92 that applies a bias voltage so as to impart a predetermined surface potential is connected to the opposite electrode 46. In the present exemplary embodiment, the bias power source 92 is provided independently from the developing power source 91.

Then, the opposite electrode 46 has a predetermined bias voltage applied thereto by the bias power source 92, adsorbs and recovers a toner cloud generated further downstream in the rotation direction of the developing roller 42 than the site where the developing roller 42 and the photoconductor drum 31 oppose each other, and also adsorbs and recovers toner by way of the developing action from the developer held on the outer periphery of the developing roller 42 (developing sleeve 42A).

A first scraper 47A is arranged with the tip end thereof abutting the outer peripheral surface of the region of the opposite electrode 46 at the opposite side to the region that opposes the developing roller 42. The first scraper 47A and a second scraper 47B are arranged with the tip ends thereof abutting. The first scraper 47A scrapes off cloud toner that has been adsorbed to the opposite electrode 46, and scrapes off toner that has been adsorbed by way of the developing action from the developer on the developing roller 42.

(2.4) Developing Operation

In the developing device 14, developer is stirred and conveyed within the developing housing 41 due to the first stirring auger 44A, the supply auger 44B, and the second stirring auger 44C rotating, and the toner and carrier that constitute the developer rub together such that the toner is charged to a negative polarity and the carrier is charged to a positive polarity. Then, when the developer that has been stirred and conveyed reaches a section opposing the developing roller 42, due to a magnetic force that acts between the N3 magnetic pole, which is a drawing-up pole, and the carrier included in the developer, some of the carrier moves toward the developing roller 42, and a developer layer produced by the developer is formed on the outer peripheral surface of the developing sleeve 42A.

The developer layer formed on the developing sleeve 42A is conveyed due to rotation of the developing sleeve 42A, and is held by the N2 magnetic pole and carried to the opening 41*a* in the developing housing 41 opposing the photoconductor drum 31, while the thickness of the developer layer is regulated using a magnetic field that is generated between the developing roller 42 and the layer regulating member 45 by the S2 magnetic pole constituting a layer regulating pole, when passing through the section opposing the layer regulating member 45. It should be noted that when passing through the section opposing the layer regulating member 45, pressure caused by packing is applied to the developer on the developing sleeve 42A, and the toner that has passed through the opposing section is additionally charged due to friction with the carrier.

A predetermined developing bias voltage is applied as a developing bias from the developing power source 91 such that a developing electric field acts on the developing sleeve 42A, in a developing region opposing the photoconductor drum 31, on the developer that has been carried to the opening 41*a* in the developing housing 41, in a state in which a strong holding force of the S1 magnetic pole constituting the main developing pole is acting.

Thus, in the developing region, toner is electrostatically transferred to the electrostatic latent image on the photoconductor drum 31 from the developer layer on the developing sleeve 42A, and the electrostatic latent image is visualized as a toner image.

Thereafter, the developer layer on the developing sleeve 42A that has passed through the developing region returns to inside the developing housing 41 due to rotation of the developing sleeve 42A, separates from the developing roller 42 and drops inside the developing housing 41 due to a repelling magnetic field formed by the N1 magnetic pole constituting a separation pole, is once again stirred and conveyed by the first stirring auger 44A, the supply auger 44B, and the second stirring auger 44C, and waits for the next developing operation.

Here, as depicted in FIG. 1, in a case where image forming is carried out by the image forming unit 10 with the continuous paper S being supplied from the paper supply device 20, the image forming operation becomes continuous running so to speak, and there is a risk of an image quality defect occurring due to limited expelling (replacing) of the toner within the developer obtained after developing that has passed through the developing region. In particular, in a case where the area coverage at which image forming is carried out is low, the consumption of toner in the developer is low and toner is liable to remain in the developer. As a result, there is an excessive increase in the embedding of an external additive in the toner surface and the toner charge amount, and there is a risk of there being a deterioration in granularity, which is referred to as color noise (CN) and quantifies density unevenness at a pitch of 1 mm or less.

Figure 4:
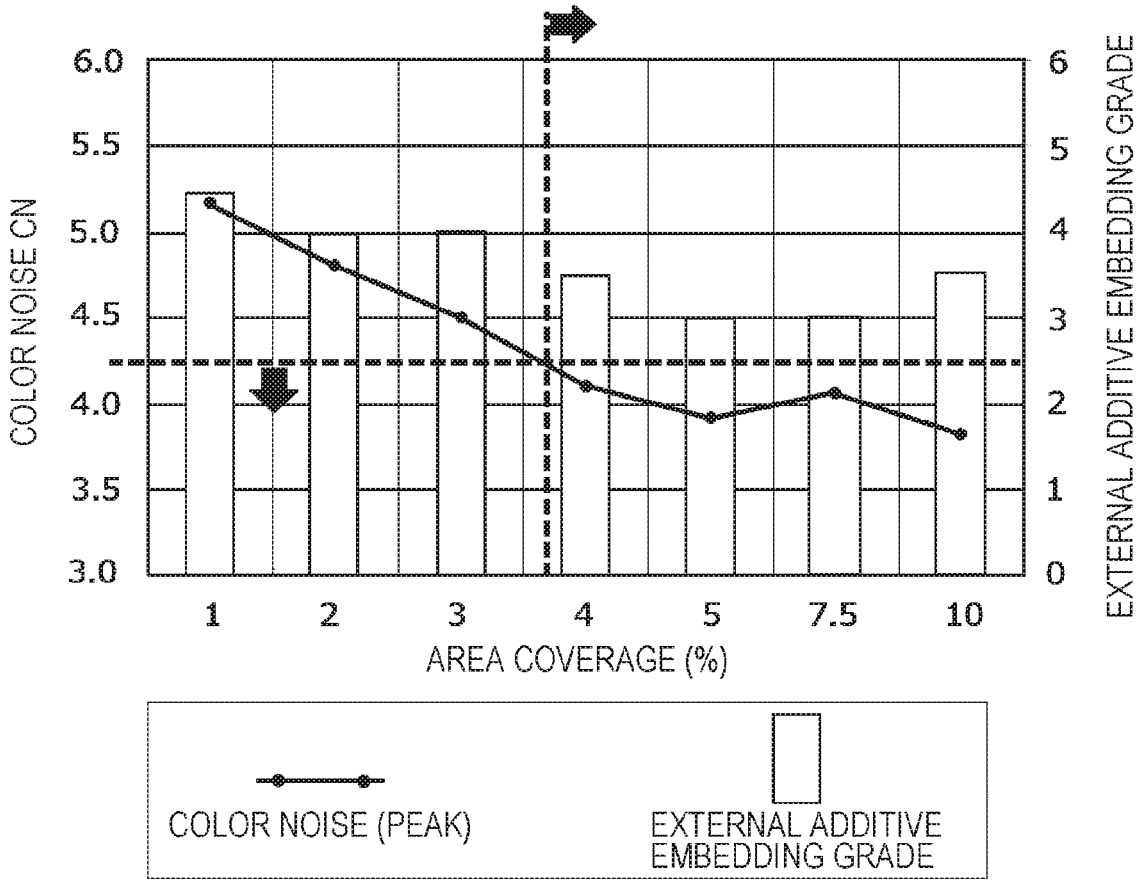
FIG. 4 is a drawing depicting an example of a relationship between area coverage, color noise, and an external additive embedding grade.

FIG. 4 depicts an example of a relationship between area coverage AC, color noise CN, and an external additive embedding grade, for the case where the continuous paper S is supplied and continuous running is carried out. Here, color noise CN quantifies granularity which is a sensory evaluation value, and signifies that image quality improves as the color noise CN decreases. Furthermore, the external additive embedding grade signifies that, as the external additive embedding grade decreases, the embedding of an external additive into toner decreases and the toner charge properties and fluidity improve.

As depicted in FIG. 4, in a case where the area coverage AC is low, the embedding grade of an external additive is high (in a case where the area coverage AC is 1%, the external additive embedding grade is 4.5) and the color noise exceeds 5. It is apparent that the color noise CN decreases if there is an increase in the area coverage AC when continuous running is carried out, and if the area coverage AC is 4% or higher, the color noise CN becomes 4.5 or less which is unremarkable in sensory terms as color noise CN.

Here, in the present exemplary embodiment, in a case where the area coverage AC is 4%, the amount of toner consumed by developing is 0.01 $g/m^2$, and the toner included in the developer obtained after developing is consumed (expelled) at an amount of 0.01 $g/m^2$ or more. It is therefore surmised that it may be possible to suppress deterioration in the color noise CN with the embedding of an external additive being suppressed even when continuous running is carried out.

(2.5) Controlling Change in Rotation Direction and Bias Voltage of Opposite Electrode In the developing device 14 in the present exemplary embodiment, deterioration in the color noise CN is suppressed with expelling of the toner within the developer obtained after developing being promoted by changing at least one of the bias voltage applied to the opposite electrode 46 and the rotation direction of the opposite electrode 46 in accordance with the area coverage AC of an electrostatic latent image formed on the photoconductor drum 31.

(2.5.1) Adsorption of Cloud Toner

Figure 5:
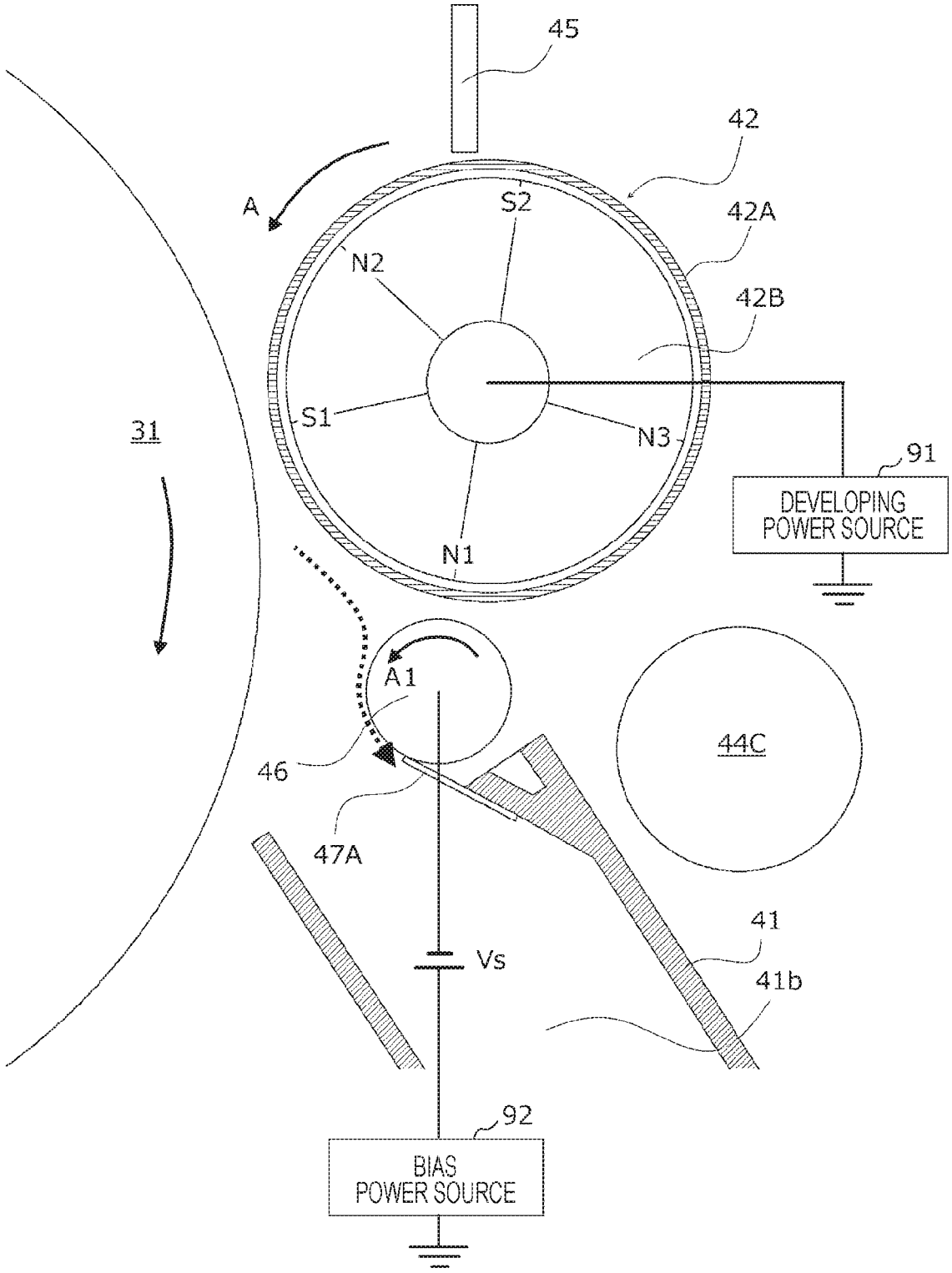
FIG. 5 is a drawing depicting a rotation direction and an applied bias voltage of the opposite electrode when cloud toner is adsorbed.

FIG. 5 depicts a rotation direction and an applied bias voltage of the opposite electrode 46 when cloud toner is adsorbed.

In the present exemplary embodiment, as depicted in FIG. 5, a potential Vs that has the same polarity (minus) as the toner and the same magnitude as the developing potential of the developing roller 42 (developing sleeve 42A) is applied to the opposite electrode 46, and the opposite electrode 46 is rotated in the same direction as the developing roller 42 (arrow A1 in FIG. 5; the outer peripheral surfaces where the developing roller 42 and the opposite electrode 46 face each other are rotated in opposite directions to each other).

Thus, the opposite electrode 46 has the same potential as the developing roller 42 and the toner within the developer obtained after developing is not expelled; however, a toner cloud that is generated further downstream in the rotation direction of the developing roller 42 than the site where the developing roller 42 and the photoconductor drum 31 oppose each other is adsorbed and recovered (see the arrow in FIG. 5).

The adsorbed cloud toner is scraped off by the first scraper 47A and is sucked by an undepicted suction device and recovered into a waste toner recovery container (not depicted) via a duct 41*b* serving as an example of an air passage provided below the developing housing 41. Thus, it may be possible to suppress leakage of the cloud toner.

(2.5.2) Expelling Toner from Developer Obtained after Developing

Figure 6:
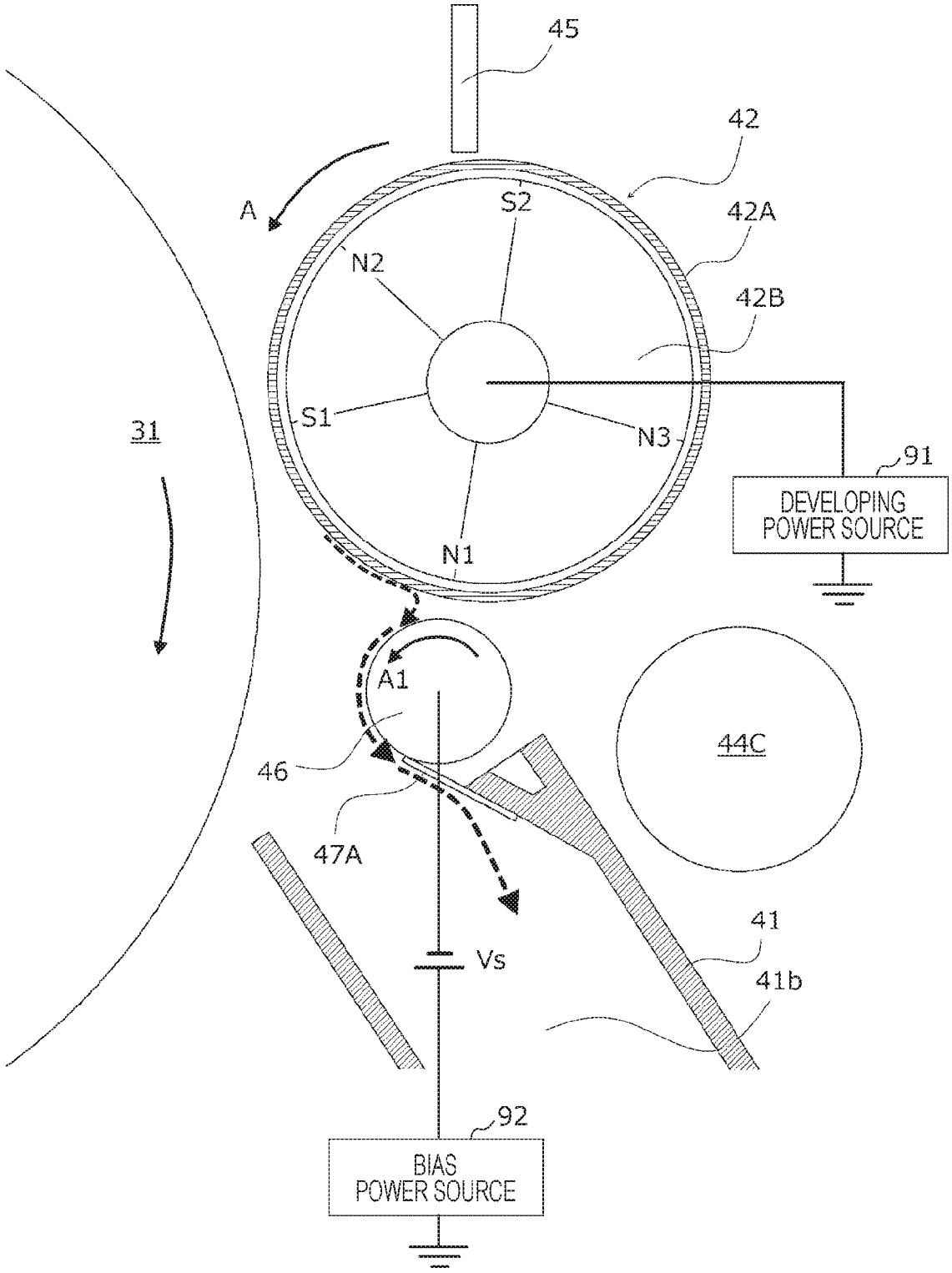
FIG. 6 is a drawing depicting a rotation direction and an applied bias voltage of the opposite electrode when toner within developer is expelled.

FIG. 6 depicts a rotation direction and an applied bias voltage of the opposite electrode 46 when the toner within developer is expelled.

In the present exemplary embodiment, as depicted in FIG. 6, a potential Vs that has the same polarity (minus) as the toner and a larger absolute value than the developing potential of the developing roller 42 (developing sleeve 42A) is applied to the opposite electrode 46, and the opposite electrode 46 is rotated in the same direction as the developing roller 42. Specifically, the developing voltage of the developing roller 42 is −150 v to −450 v, and therefore a bias voltage of 0 v to −100 v is applied. Here, 0 v is the ground state.

Thus, the opposite electrode 46 has a potential that is 50 v to 450 v higher than the developing roller 42, and the toner within the developer obtained after developing flies (develops) toward the opposite electrode 46 and is adsorbed onto the outer peripheral surface of the opposite electrode 46 (see the arrows in FIG. 6).

The adsorbed toner is scraped off by the first scraper 47A and is sucked by the suction device and recovered into the waste toner recovery container via the duct 41*b* provided below the developing housing 41. Thus, the toner within the developer obtained after developing is expelled, new developer is supplied from the supply auger 44B to the developing roller 42, and it may be possible to suppress image quality defects caused by toner deterioration and toner charge fluctuation even when images having a low area coverage AC are continuously formed.

Figure 7:
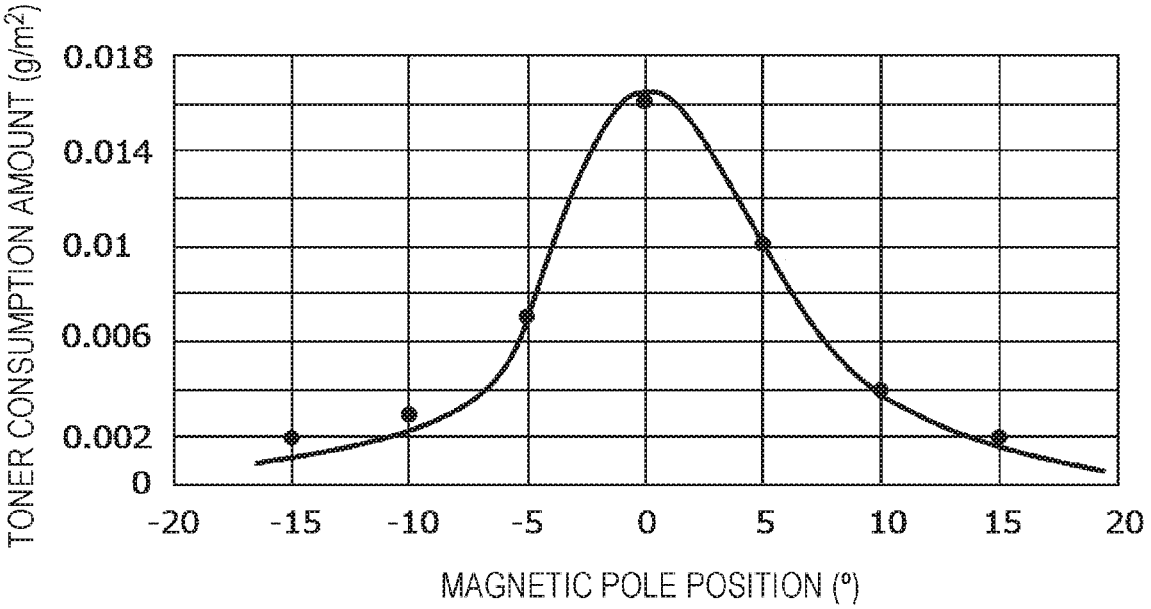
FIG. 7 is a drawing depicting a relationship between the relative positions of the opposite electrode and a separation pole of the developing roller, and the amount of toner that flies toward and is consumed by the opposite electrode.

FIG. 7 depicts a relationship between the relative positions of the opposite electrode 46 and the N1 magnetic pole constituting the separation pole of the developing roller 42, and the amount of toner that flies toward and is consumed by the opposite electrode 46. As depicted in FIG. 7, the amount of consumed toner is the highest at a position (0°) where the opposite electrode 46 opposes the N1 magnetic pole, and the amount of consumed toner decreases the more the N1 magnetic pole and the opposite electrode 46 deviate from facing each other. In the present exemplary embodiment, the opposite electrode 46 is arranged in a position opposing the N1 magnetic pole of the developing roller 42, and a decline in the amount of toner adsorbed by the opposite electrode 46 is limited.

Figure 8:
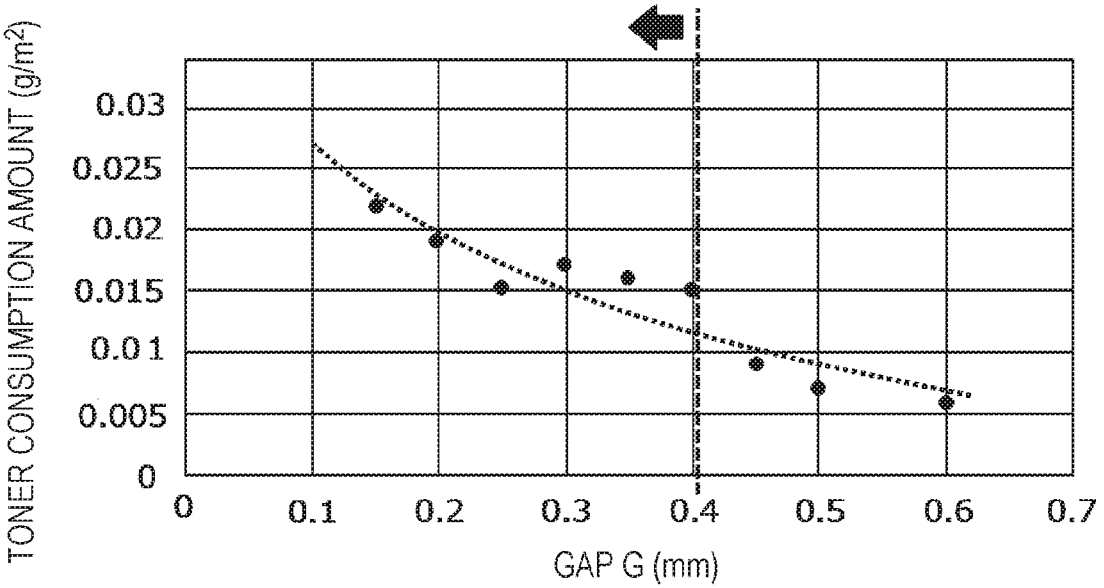
FIG. 8 is a drawing depicting a relationship between a gap between the opposite electrode and the developing roller and the amount of toner that flies toward and is consumed by the opposite electrode.

FIG. 8 depicts a relationship between the gap G between the opposite electrode 46 and the developing roller 42 and the amount of toner that flies toward and is consumed by the opposite electrode 46. As depicted in FIG. 8, the amount of consumed toner increases as the gap G between the opposite electrode 46 and the developing roller 42 becomes smaller. In the present exemplary embodiment, the gap G between the outer peripheral surface of the opposite electrode 46 and the outer peripheral surface of the developing roller 42 is set to 0.4 mm or less, and the amount of consumed toner becomes 0.01 g/m$^2$ or more which is equivalent to an area coverage of 4% with which a deterioration in the color noise CN is difficult to be perceived in sensory terms.

(2.5.3) Operation of Developing Device

Figure 9:
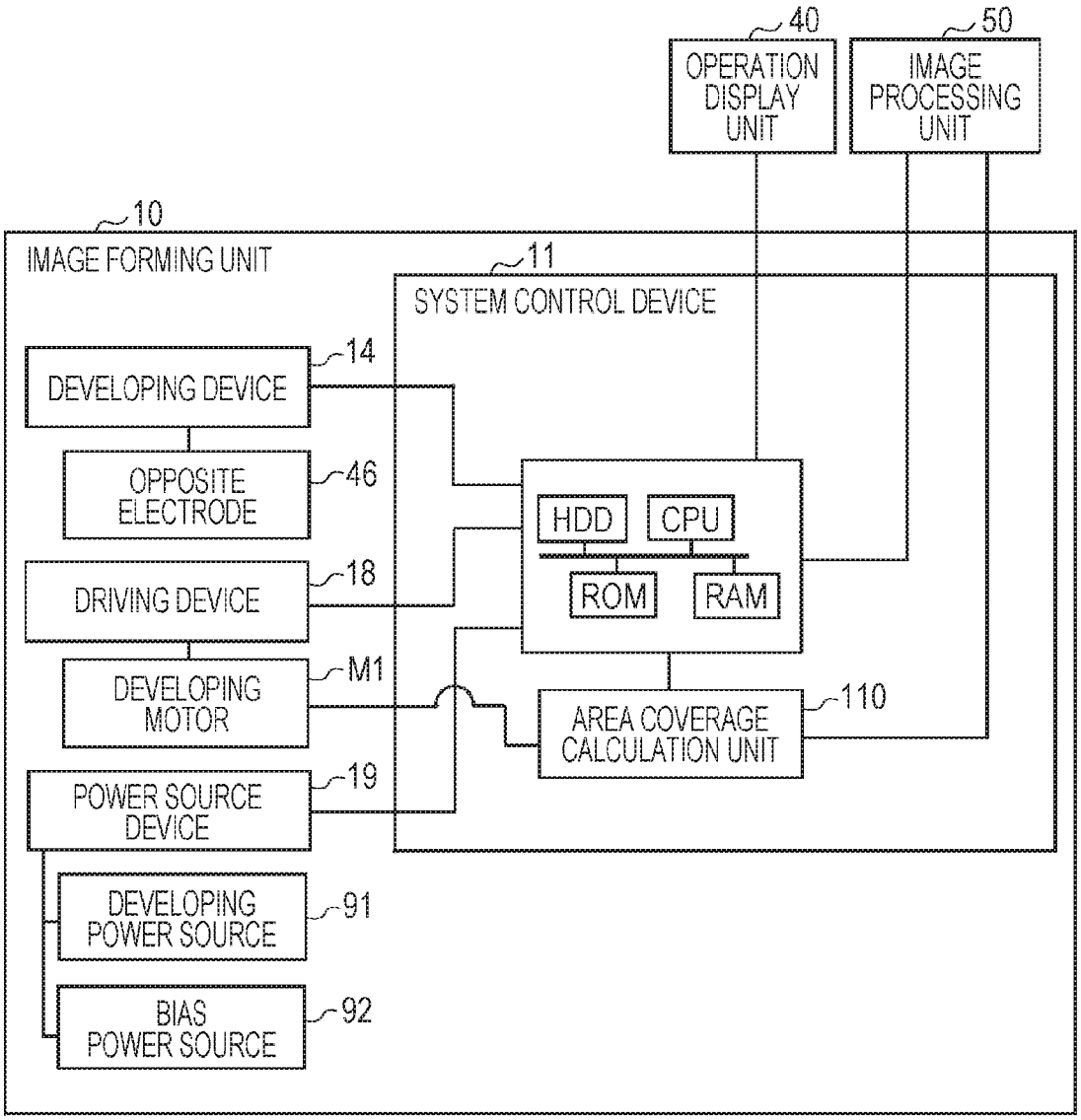
FIG. 9 is a functional block diagram depicting a functional configuration of an image forming unit.
Figure 10:
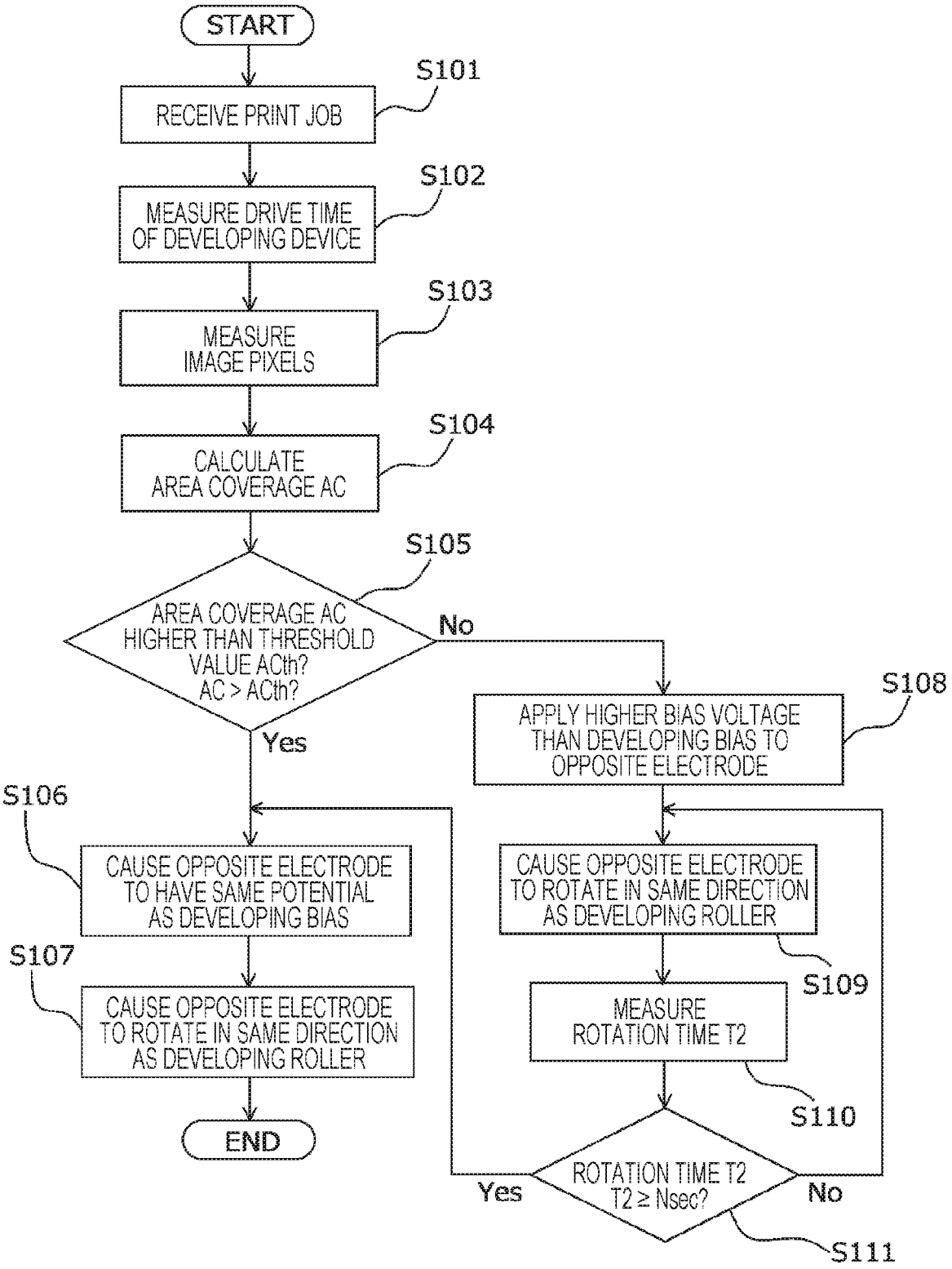
FIG. 10 is a flowchart depicting an operation flow of the developing device during continuous running.

FIG. 9 is a functional block diagram depicting a functional configuration of the image forming unit 10, and FIG. 10 is a flowchart depicting an operation flow of the developing device 14 during continuous running.

As depicted in FIG. 10 as a flowchart, in the developing device 14 which is a main part of the image forming unit 10 in the present exemplary embodiment, printing control is carried out with predetermined developing conditions (parameters) being set by the system control device 11 which serves as an example of a controller.

The system control device 11 functions as a controller that changes at least one of the bias voltage applied to the opposite electrode 46 and the rotation direction of the opposite electrode 46 in accordance with the area coverage AC of an electrostatic latent image formed on the photoconductor drum 31.

The system control device 11, upon receiving a print job (S101), measures the rotational drive time T1 of the developing device 14 (S102), and also measures the total image pixels P for the print job using the image processing unit 50 (S103). Then, an area coverage calculation unit 110 calculates the area coverage AC for the print job on the basis of the rotational drive time T1 of the developing device 14 in the print job and the total image pixels P for the print job (S104), and determines whether or not the area coverage AC is higher than a predetermined threshold value ACth (S105). In the present exemplary embodiment, the threshold value ACth is set to 4%.

If it is determined as a result of the determination that the area coverage AC for the print job is higher than the threshold value ACth (S105: yes), a potential Vs that has the same polarity (minus) as the toner and the same magnitude as the developing roller 42 (developing sleeve 42A) is applied to the opposite electrode 46 (S106), and the opposite electrode 46 is rotated in the same direction as the developing roller 42 (S107; see FIG. 5). Thus, a toner cloud that is generated further downstream in the rotation direction of the developing roller 42 than the site where the developing roller 42 and the photoconductor drum 31 oppose each other is adsorbed and recovered, and it may be possible to suppress leakage of the cloud toner.

If it is determined in step S105 that the area coverage AC for the print job is lower than the threshold value ACth (S105: no), a potential Vs that has the same polarity (minus) as the toner and a larger absolute value than the developing potential of the developing roller 42 (developing sleeve 42A) is applied to the opposite electrode 46 (S108), and the opposite electrode 46 is rotated in the same direction as the developing roller 42 (S109; see FIG. 6).

The system control device 11 measures the rotation time T2 of the opposite electrode 46 (S110), and if the rotation time T2 of the opposite electrode 46 has elapsed a predetermined time (Nsec) (S111: yes), the opposite electrode 46 is switched to a potential Vs having the same magnitude as the developing roller 42 (developing sleeve 42A). Thus, the toner within the developer obtained after developing is expelled, and it may be possible to suppress image quality defects caused by toner deterioration and toner charge fluctuation even when images having a low area coverage AC are continuously formed.

Second Exemplary Embodiment

Figure 11:
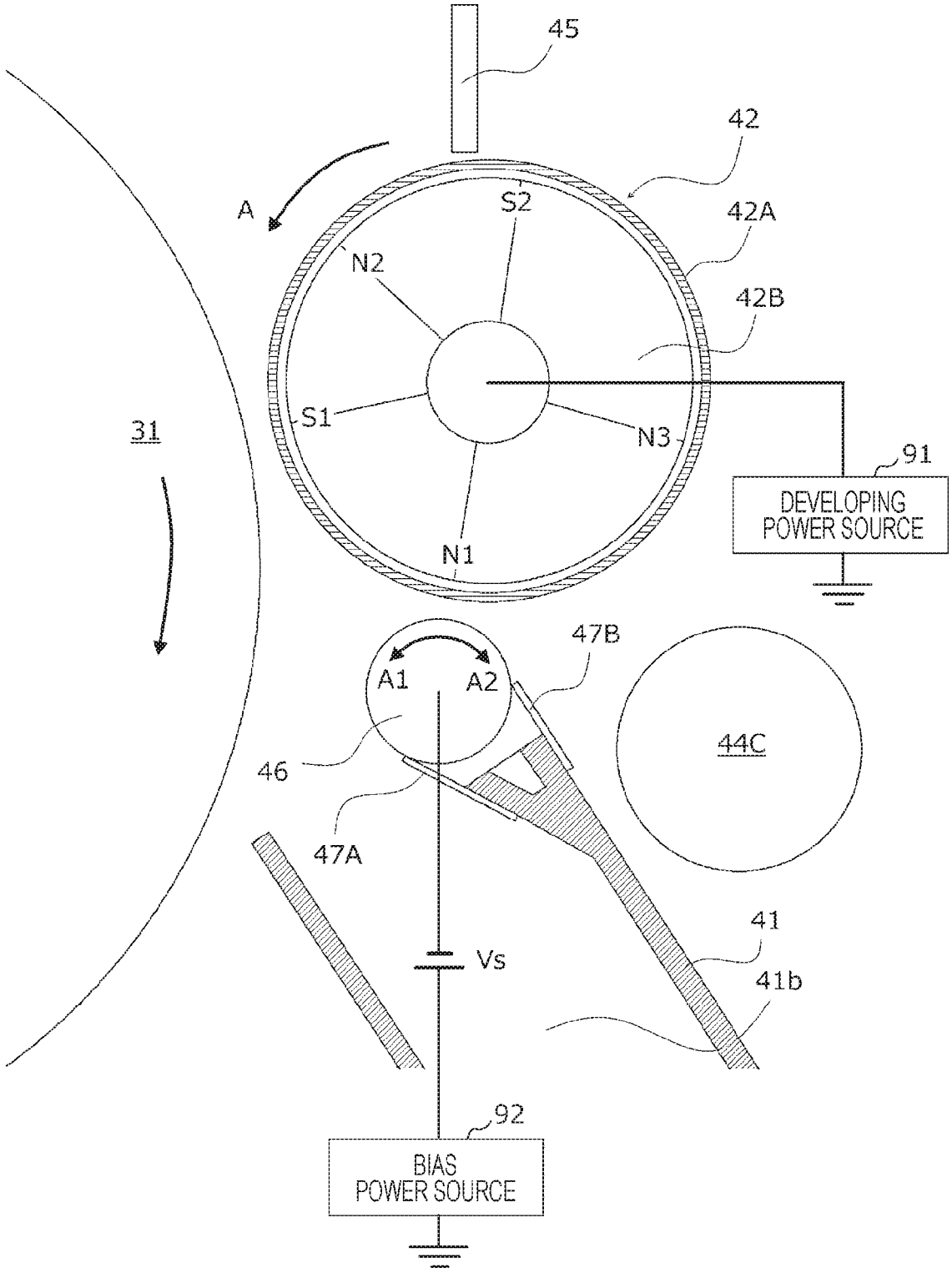
FIG. 11 is a partial cross-sectional view depicting a developing roller and an opposite electrode of a developing device in which a second exemplary embodiment is applied.

FIG. 11 is a partial cross-sectional view depicting the developing roller 42 and the opposite electrode 46 of the developing device 14 in which a second exemplary embodiment is applied. It should be noted that configurations that are the same as in the first exemplary embodiment are denoted by the same reference characters, and detailed descriptions thereof are omitted here.

(1) Configuration of Developing Device 14

Below the developing roller 42 in the opening opposing the photoconductor drum 31 in the developing housing 41, the opposite electrode 46 is arranged in a position opposing the N1 magnetic pole of the developing roller 42 with there being the predetermined gap G with the outer peripheral surface of the developing roller 42. Similar to the first exemplary embodiment, the gap G between the outer peripheral surface of the developing roller 42 and the outer peripheral surface of the opposite electrode 46 is 0.4 mm or less, which is narrower than the gap between the photoconductor drum 31 and the developing roller 42.

Furthermore, the opposite electrode 46 is rotated in the same direction (the direction of arrow A1) or the opposite direction (the direction of arrow A2) with respect to the rotation direction (the direction of arrow A) of the developing roller 42 (developing sleeve 42A). The bias power source 92 that applies a bias voltage so as to impart a predetermined surface potential is connected to the opposite electrode 46. In the present exemplary embodiment, the bias power source 92 is provided independently from the developing power source 91.

Then, the opposite electrode 46 has a predetermined bias voltage applied thereto by the bias power source 92, adsorbs and recovers a toner cloud generated further downstream in the rotation direction of the developing roller 42 than the site where the developing roller 42 and the photoconductor drum 31 oppose each other, and also adsorbs and recovers toner by way of the developing action from the developer held on the outer periphery of the developing roller 42 (developing sleeve 42A).

The first scraper 47A is arranged with the tip end thereof abutting the outer peripheral surface of the region of the opposite electrode 46 at the opposite side to the region that opposes the developing roller 42. Furthermore, the second scraper 47B is arranged with a tip end thereof abutting the outer peripheral surface of the region of the opposite electrode 46 that opposes the developing roller 42.

The first scraper 47A scrapes off toner that has adsorbed to the opposite electrode 46 by way of the developing action from the developer on the developing roller 42. The second scraper 47B scrapes off cloud toner that has adsorbed to the opposite electrode 46.

(2) Action of Opposite Electrode (2.1) Adsorption of Cloud Toner

Figure 12:
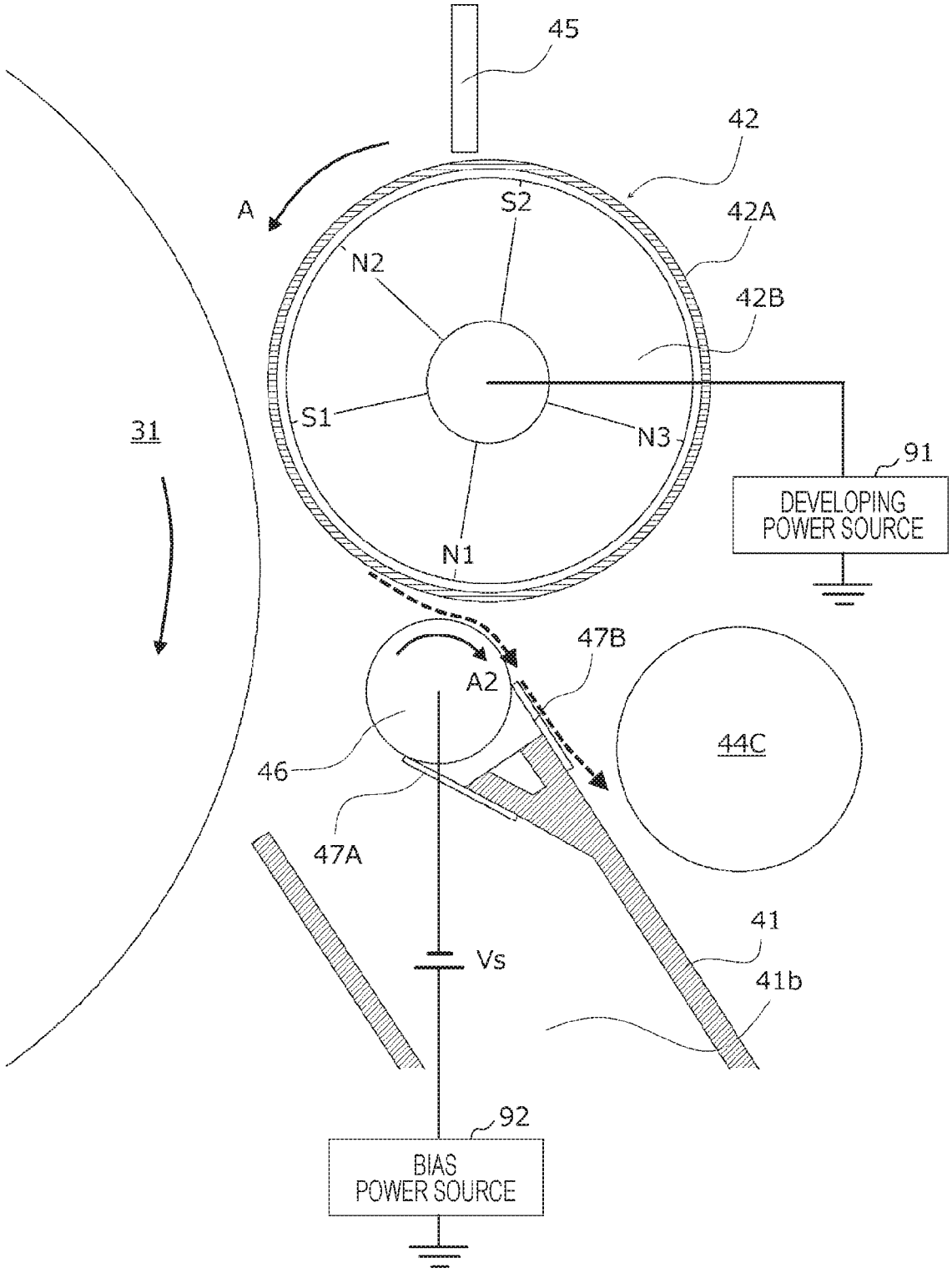
FIG. 12 is a drawing depicting a rotation direction and an applied bias voltage of the opposite electrode when cloud toner is adsorbed.

FIG. 12 depicts a rotation direction and an applied bias voltage of the opposite electrode 46 when cloud toner is adsorbed.

In the present exemplary embodiment, as depicted in FIG. 12, the opposite electrode 46 is rotated in the opposite direction to the developing roller 42 (arrow A2 in FIG. 12; the outer peripheral surfaces where the developing roller 42 and the opposite electrode 46 face each other rotate in the same direction as each other), and a potential Vs that has the same polarity (minus) as the toner and the same magnitude as the developing roller 42 (developing sleeve 42A) is applied.

Thus, the opposite electrode 46 has the same potential as the developing roller 42 and the toner within the developer obtained after developing is not expelled; however, a toner cloud that is generated further downstream in the rotation direction of the developing roller 42 than the site where the developing roller 42 and the photoconductor drum 31 oppose each other is adsorbed and recovered (see the arrows in FIG. 12).

The adsorbed cloud toner is scraped off by the second scraper 47B and is recovered to inside the developing housing 41. Thus, it may be possible to suppress leakage of the cloud toner.

(2.2) Expelling Toner from Developer Obtained After Developing

Figure 13:
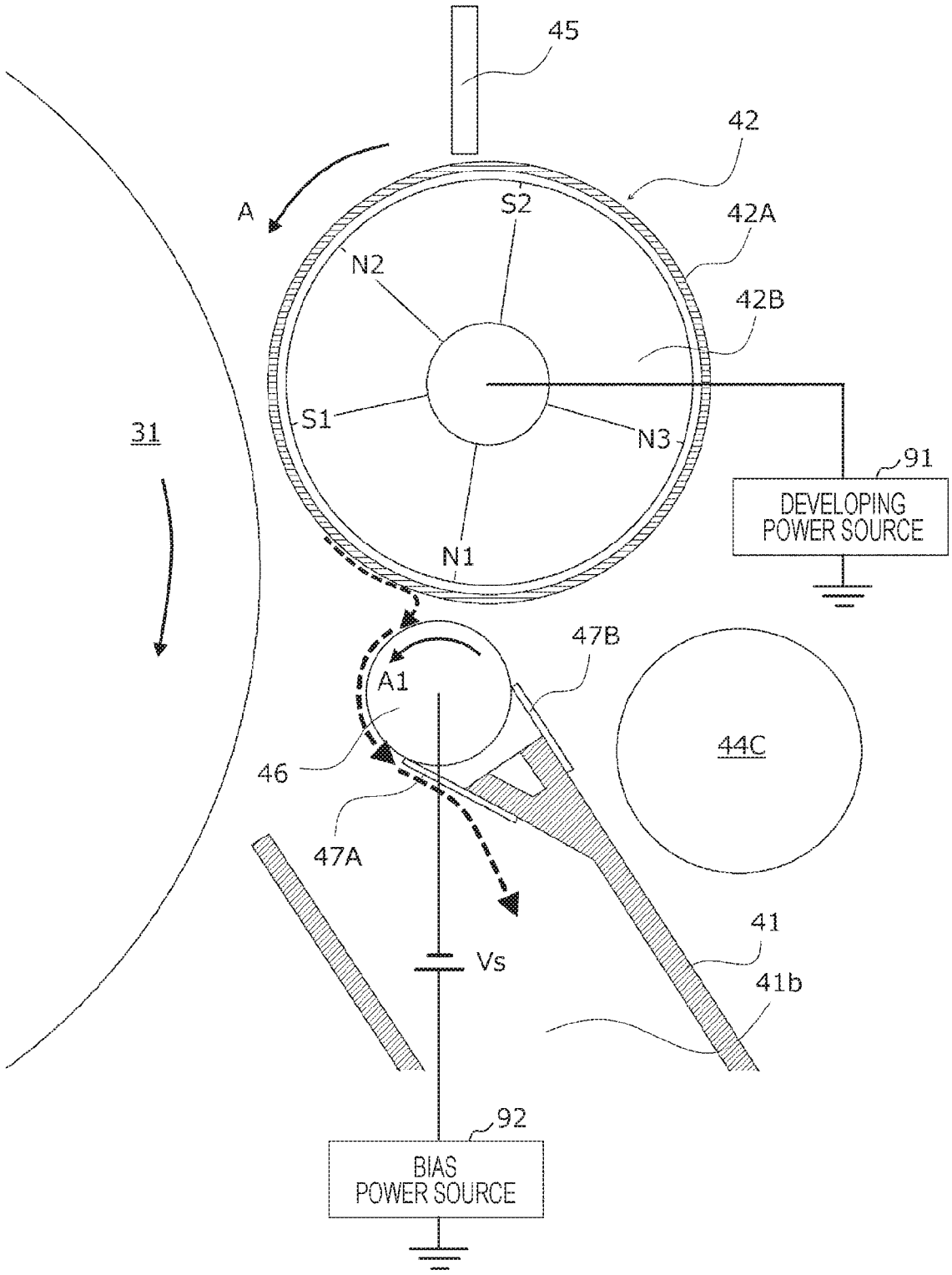
FIG. 13 is a drawing depicting a rotation direction and an applied bias voltage of the opposite electrode when toner within developer is expelled.

FIG. 13 depicts a rotation direction and an applied bias voltage of the opposite electrode 46 when toner within developer is expelled.

In the present exemplary embodiment, as depicted in FIG. 13, the opposite electrode 46 is rotated in the same direction as the developing roller 42, and a potential Vs that has the same polarity (minus) as the toner and a larger absolute value than the developing potential of the developing roller 42 (developing sleeve 42A) is applied.

Thus, the opposite electrode 46 has a higher potential than the developing roller 42, and the toner within the developer obtained after developing flies toward the opposite electrode 46 and is adsorbed onto the outer peripheral surface of the opposite electrode 46 (see the arrows in FIG. 13).

The adsorbed toner is scraped off by the first scraper 47A and is sucked by the undepicted suction device and recovered into the waste toner recovery container (not depicted) via the duct 41*b* provided below the developing housing 41. Thus, the toner within the developer obtained after developing is expelled, new developer is supplied from the supply auger 44B to the developing roller 42, and it may be possible to suppress image quality defects caused by toner deterioration and toner charge fluctuation even when images having a low area coverage AC are continuously formed.

(2.3) Operation of Developing Device

Figure 14:
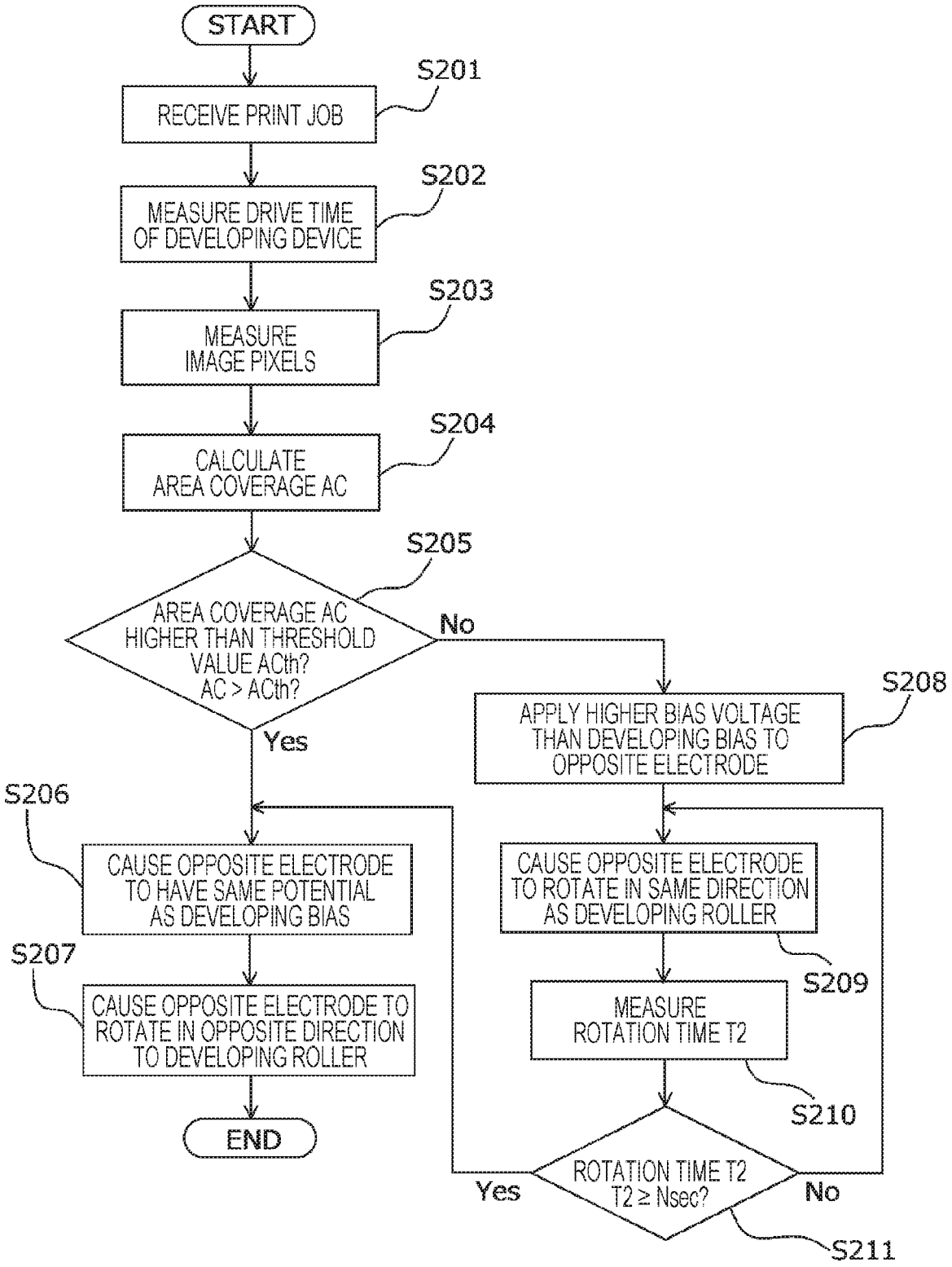
FIG. 14 is a flowchart depicting an operation flow of the developing device during continuous running.

FIG. 14 is a flowchart depicting an operation flow of the developing device 14 during continuous running.

The system control device 11, upon receiving a print job (S201), measures the rotational drive time T1 of the developing device 14 (S202), and also measures the total image pixels P for the print job using the image processing unit 50 (S203). Then, the area coverage calculation unit 110 calculates the area coverage AC for the print job on the basis of the rotational drive time T1 of the developing device 14 in the print job and the total image pixels P for the print job (S204), and determines whether or not the area coverage AC is higher than the predetermined threshold value ACth (S205). In the present exemplary embodiment, the threshold value ACth is set to 4%.

If it is determined as a result of the determination that the area coverage AC for the print job is higher than the threshold value ACth (S205: yes), a potential Vs that has the same polarity (minus) as the toner and the same magnitude as the developing roller 42 (developing sleeve 42A) is applied to the opposite electrode 46 (S206), and the opposite electrode 46 is rotated in the opposite direction to the developing roller 42 (S207; see FIG. 12). Thus, a toner cloud that is generated further downstream in the rotation direction of the developing roller 42 than the site where the developing roller 42 and the photoconductor drum 31 oppose each other is adsorbed and recovered, and it may be possible to suppress leakage of the cloud toner.

If it is determined in step S205 that the area coverage AC for the print job is lower than the threshold value ACth (S205: no), a potential Vs that has the same polarity (minus) as the toner and a larger absolute value than the developing potential of the developing roller 42 (developing sleeve 42A) is applied to the opposite electrode 46 (S208), and the opposite electrode 46 is rotated in the same direction as the developing roller 42 (S209; see FIG. 13).

The system control device 11 measures the rotation time T2 of the opposite electrode 46 (S210), and if the rotation time T2 of the opposite electrode 46 has elapsed a predetermined time (Nsec) (S211: yes), the opposite electrode 46 is switched to a potential Vs having the same magnitude as the developing roller 42 (developing sleeve 42A). Thus, the toner within the developer obtained after developing is expelled, and it may be possible to suppress image quality defects caused by toner deterioration and toner charge fluctuation even when images having a low area coverage AC are continuously formed.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming device comprising:

a developer holder that is rotatably arranged opposing a latent image holder configured to hold an electrostatic latent image, wherein the developer holder is configured to hold developer including carrier and toner charged to a predetermined regular polarity, wherein the developer holder is configured to have a potential of the same polarity as the regular polarity applied thereto, and wherein the developer holder is configured to develop the electrostatic latent image using the toner;

an opposite electrode that is arranged opposing the developer holder with a predetermined gap therebetween; and a controller configured to change at least one of a potential applied to the opposite electrode and a rotation direction of the opposite electrode in accordance with an area coverage of the electrostatic latent image of the latent image holder, wherein the opposite electrode is arranged further downstream in a rotation direction of the developer holder than a section where the developer holder and the latent image holder oppose each other, wherein the opposite electrode is configured to adsorb the toner that has adhered to a surface of the developer holder, and wherein the opposite electrode is arranged with the gap with the developer holder being narrower than a gap between the latent image holder and the developer holder.

2. The image forming device according to claim 1, wherein the opposite electrode is arranged in a position opposing a magnetic pole of the developer holder.

3. An image forming device comprising:

a developer holder that is rotatably arranged opposing a latent image holder configured to hold an electrostatic latent image, wherein the developer holder is configured to hold developer including carrier and toner charged to a predetermined regular polarity, wherein the developer holder is configured to have a potential of the same polarity as the regular polarity applied thereto, and wherein the developer holder is configured to develop the electrostatic latent image using the toner;

an opposite electrode that is arranged opposing the developer holder with a predetermined gap therebetween; and a controller configured to change at least one of a potential applied to the opposite electrode and a rotation direction of the opposite electrode in accordance with an area coverage of the electrostatic latent image of the latent image holder, wherein the controller is configured to, if the area coverage is lower than a predetermined threshold value, apply, to the opposite electrode, a potential having the same polarity as the regular polarity and an absolute value that is larger than that of the developer holder.

4. An image forming device comprising:

a developer holder that is rotatably arranged opposing a latent image holder configured to hold an electrostatic latent image, wherein the developer holder is configured to hold developer including carrier and toner charged to a predetermined regular polarity, wherein the developer holder is configured to have a potential of the same polarity as the regular polarity applied thereto, and wherein the developer holder is configured to develop the electrostatic latent image using the toner;

an opposite electrode that is arranged opposing the developer holder with a predetermined gap therebetween; and a controller configured to change at least one of a potential applied to the opposite electrode and a rotation direction of the opposite electrode in accordance with an area coverage of the electrostatic latent image of the latent image holder, wherein the opposite electrode is arranged further downstream in a rotation direction of the developer holder than a section where the developer holder and the latent image holder oppose each other, wherein the opposite electrode is configured to adsorb the toner that has adhered to a surface of the developer holder, and wherein the controller is configured to, if the area coverage is lower than a predetermined threshold value, apply, to the opposite electrode, a potential having the same polarity as the regular polarity and an absolute value that is larger than that of the developer holder.

5. The image forming device according to claim 1, wherein the controller is configured to, if the area coverage is lower than a predetermined threshold value, apply, to the opposite electrode, a potential having the same polarity as the regular polarity and an absolute value that is larger than that of the developer holder.

6. An image forming device comprising:

a developer holder that is rotatably arranged opposing a latent image holder configured to hold an electrostatic latent image, wherein the developer holder is configured to hold developer including carrier and toner charged to a predetermined regular polarity, wherein the developer holder is configured to have a potential of the same polarity as the regular polarity applied thereto, and wherein the developer holder is configured to develop the electrostatic latent image using the toner;

an opposite electrode that is arranged opposing the developer holder with a predetermined gap therebetween; and a controller configured to change at least one of a potential applied to the opposite electrode and a rotation direction of the opposite electrode in accordance with an area coverage of the electrostatic latent image of the latent image holder, wherein the opposite electrode is arranged further downstream in a rotation direction of the developer holder than a section where the developer holder and the latent image holder oppose each other, wherein the opposite electrode is configured to adsorb the toner that has adhered to a surface of the developer holder, wherein the opposite electrode is arranged in a position opposing a magnetic pole of the developer holder, and wherein the controller is configured to, if the area coverage is lower than a predetermined threshold value, apply, to the opposite electrode, a potential having the same polarity as the regular polarity and an absolute value that is larger than that of the developer holder.

7. The image forming device according to claim 2, wherein the controller is configured to, if the area coverage is lower than a predetermined threshold value, apply, to the opposite electrode, a potential having the same polarity as the regular polarity and an absolute value that is larger than that of the developer holder.

8. An image forming device comprising:

a developer holder that is rotatably arranged opposing a latent image holder configured to hold an electrostatic latent image, wherein the developer holder is configured to hold developer including carrier and toner charged to a predetermined regular polarity, wherein the developer holder is configured to have a potential of the same polarity as the regular polarity applied thereto, and wherein the developer holder is configured to develop the electrostatic latent image using the toner;

an opposite electrode that is arranged opposing the developer holder with a predetermined gap therebetween; and a controller configured to change at least one of a potential applied to the opposite electrode and a rotation direction of the opposite electrode in accordance with an area coverage of the electrostatic latent image of the latent image holder, wherein the controller is configured to, if the area coverage is higher than a predetermined threshold value, apply to the opposite electrode, a potential having the same polarity as the regular polarity and the same magnitude as that of the developer holder.

9. An image forming device comprising:

a developer holder that is rotatably arranged opposing a latent image holder configured to hold an electrostatic latent image, wherein the developer holder is configured to hold developer including carrier and toner charged to a predetermined regular polarity, wherein the developer holder is configured to have a potential of the same polarity as the regular polarity applied thereto, and wherein the developer holder is configured to develop the electrostatic latent image using the toner;

an opposite electrode that is arranged opposing the developer holder with a predetermined gap therebetween; and a controller configured to change at least one of a potential applied to the opposite electrode and a rotation direction of the opposite electrode in accordance with an area coverage of the electrostatic latent image of the latent image holder, wherein the opposite electrode is arranged further downstream in a rotation direction of the developer holder than a section where the developer holder and the latent image holder oppose each other, wherein the opposite electrode is configured to adsorb the toner that has adhered to a surface of the developer holder, and wherein the controller is configured to, if the area coverage is higher than a predetermined threshold value, apply to the opposite electrode, a potential having the same polarity as the regular polarity and the same magnitude as that of the developer holder.

10. The image forming device according to claim 1, wherein the controller is configured to, if the area coverage is higher than a predetermined threshold value, apply to the opposite electrode, a potential having the same polarity as the regular polarity and the same magnitude as that of the developer holder.

11. An image forming device comprising:

a developer holder that is rotatably arranged opposing a latent image holder configured to hold an electrostatic latent image, wherein the developer holder is configured to hold developer including carrier and toner charged to a predetermined regular polarity, wherein the developer holder is configured to have a potential of the same polarity as the regular polarity applied thereto, and wherein the developer holder is configured to develop the electrostatic latent image using the toner;

an opposite electrode that is arranged opposing the developer holder with a predetermined gap therebetween; and a controller configured to change at least one of a potential applied to the opposite electrode and a rotation direction of the opposite electrode in accordance with an area coverage of the electrostatic latent image of the latent image holder, wherein the opposite electrode is arranged further downstream in a rotation direction of the developer holder than a section where the developer holder and the latent image holder oppose each other, wherein the opposite electrode is configured to adsorb the toner that has adhered to a surface of the developer holder, wherein the opposite electrode is arranged in a position opposing a magnetic pole of the developer holder, and wherein the controller is configured to, if the area coverage is higher than a predetermined threshold value, apply to the opposite electrode, a potential having the same polarity as the regular polarity and the same magnitude as that of the developer holder.

12. The image forming device according to claim 2, wherein the controller is configured to, if the area coverage is higher than a predetermined threshold value, apply to the opposite electrode, a potential having the same polarity as the regular polarity and the same magnitude as that of the developer holder.

13. The image forming device according to claim 3, further comprising a first scraping member configured to contact the opposite electrode in a region of the opposite electrode at the opposite side to a region opposing the developer holder, wherein the first scraping member is configured to scrape off the toner that has adhered to the opposite electrode from the opposite electrode, and wherein the controller is configured to cause the opposite electrode to rotate in the same direction as the developer holder.

14. The image forming device according to claim 8, further comprising a first scraping member configured to contact the opposite electrode in a region of the opposite electrode at the opposite side to a region opposing the developer holder, wherein the first scraping member is configured to scrape off the toner that has adhered to the opposite electrode from the opposite electrode, and wherein the controller is configured to cause the opposite electrode to rotate in the same direction as the developer holder.

15. The image forming device according to claim 8, further comprising a second scraping member configured to contact the opposite electrode in a region of the opposite electrode that opposes the developer holder, wherein the second scraping member is configured to scrape off the toner that has adhered to the opposite electrode from the opposite electrode, and wherein the controller is configured to cause the opposite electrode to rotate in the opposite direction to the developer holder.

16. The image forming device according to claim 13, wherein an air passage is present below the first scraping member, and wherein the toner that has been scraped off by the first scraping member is sucked together with air through the air passage and is recovered.

17. The image forming device according to claim 14, wherein an air passage is present below the first scraping member, and wherein the toner that has been scraped off by the first scraping member is sucked together with air through the air passage and is recovered.

* * * * *